US010074500B2

(12) United States Patent
Neyens et al.

(10) Patent No.: US 10,074,500 B2
(45) Date of Patent: Sep. 11, 2018

(54) LOW PROFILE FUSIBLE DISCONNECT SWITCH DEVICE

(71) Applicant: EATON INTELLIGENT POWER LIMITED, Dublin OT (IE)

(72) Inventors: Tyler John Neyens, St. Louis, MO (US); Patrick Alexander von zur Muehlen, Wildwood, MO (US); Matthew Rain Darr, Edwardsville, IL (US); Shungang Su, Xi'an (CN); Jessica Ann Dunker, Wildwood, MO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 279 days.

(21) Appl. No.: 14/561,875

(22) Filed: Dec. 5, 2014

(65) Prior Publication Data

US 2016/0163491 A1 Jun. 9, 2016

(51) Int. Cl.

| | |
|---|---|
| ***H01H 85/02*** | (2006.01) |
| ***H01H 1/58*** | (2006.01) |
| ***H01H 85/36*** | (2006.01) |
| ***H01H 9/10*** | (2006.01) |
| ***H01H 85/30*** | (2006.01) |

(52) U.S. Cl.

CPC ..... *H01H 85/02* (2013.01); *H01H 1/5833* (2013.01); *H01H 9/10* (2013.01); *H01H 9/104* (2013.01); *H01H 85/30* (2013.01); *H01H 85/36* (2013.01); *H01H 2235/01* (2013.01)

(58) Field of Classification Search

CPC ..... H01H 85/02; H01H 1/5833; H01H 85/36; H01H 85/30; H01H 9/10; H01H 9/104; H01H 2235/01; H01H 85/22; H01H 85/54; H01H 85/545; H01H 85/56; H01H 85/58; H01H 85/60; H01H 31/125

USPC ..... 337/195, 168, 403, 187

See application file for complete search history.

(56) References Cited

U.S. PATENT DOCUMENTS

| | | | | |
|---|---|---|---|---|
| 3,009,035 A | | 11/1961 | Reichert et al. | |
| 3,474,373 A | * | 10/1969 | Myers | H01H 9/10 337/150 |
| 3,778,633 A | * | 12/1973 | DeVisser | H01H 3/264 200/50.35 |

(Continued)

FOREIGN PATENT DOCUMENTS

| | | | | |
|---|---|---|---|---|
| FR | 2452776 A1 | | 10/1980 | |
| WO | WO 9928936 A1 | * | 6/1999 | H01H 9/104 |
| WO | 2009064769 A1 | | 5/2009 | |

OTHER PUBLICATIONS

International Search Report and Written Opinion for International Application No. PCT/US2015/062286, Mar. 1, 2016, 13 pages.

*Primary Examiner* — Jayprakash N Gandhi
*Assistant Examiner* — Stephen Sul
(74) *Attorney, Agent, or Firm* — Armstrong Teasdale LLP

(57) ABSTRACT

A compact fusible disconnect switch device having a reduced switch housing size and increased power density is configured to be face mounted to a panel. A fuse cover assembly allows installation and removal of a fuse without having to open the panel. Line-side and load-side terminals are provided on a common side of the housing. In-line mechanical ganging and simultaneous application is provided for combinations of the compact fusible disconnect switch devices.

42 Claims, 9 Drawing Sheets

(56) References Cited

U.S. PATENT DOCUMENTS

| | | | | | |
|---|---|---|---|---|---|
| 4,438,477 | A * | 3/1984 | Cawley | H02H 9/06 | 361/111 |
| 4,762,510 | A * | 8/1988 | Schaefer | H01R 13/68 | 337/195 |
| 4,981,448 | A * | 1/1991 | Herbert | H01H 85/542 | 439/620.29 |
| 5,109,142 | A * | 4/1992 | von Kannewurff | H01H 71/1018 | 200/43.21 |
| 5,172,087 | A * | 12/1992 | Castonguay | H01H 71/1018 | 200/50.4 |
| 6,870,729 | B2 * | 3/2005 | Johnsen | H02B 1/06 | 200/50.03 |
| 2002/0067279 | A1 * | 6/2002 | Torrez | H01H 85/306 | 340/638 |
| 2004/0196134 | A1 * | 10/2004 | Milanczak | H01H 85/547 | 337/187 |
| 2007/0252670 | A1 | 11/2007 | Darr | | |
| 2011/0169599 | A1 * | 7/2011 | Darr | H01H 9/10 | 337/143 |
| 2012/0154987 | A1 * | 6/2012 | Mills | H05K 7/209 | 361/676 |
| 2013/0329332 | A1 * | 12/2013 | Funcheon | G01R 31/026 | 361/104 |

* cited by examiner

LOW PROFILE FUSIBLE DISCONNECT SWITCH DEVICE

BACKGROUND OF THE INVENTION

The field of the invention relates generally to fusible circuit protection devices, and more specifically to fusible disconnect switch devices configured for high current industrial applications.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current flowing through the fuse exceeds a predetermined limit, the fusible elements melt and open one or more circuits through the fuse to prevent electrical component damage.

A variety of fusible disconnect switch devices are known in the art wherein fused output power may be selectively switched from a power supply input. Existing fusible disconnect switch devices, however, have not completely met the needs of the marketplace and improvements are desired. Specifically, high current applications present additional demands on fusible switch disconnect devices that are not well met by existing fusible disconnect devices.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
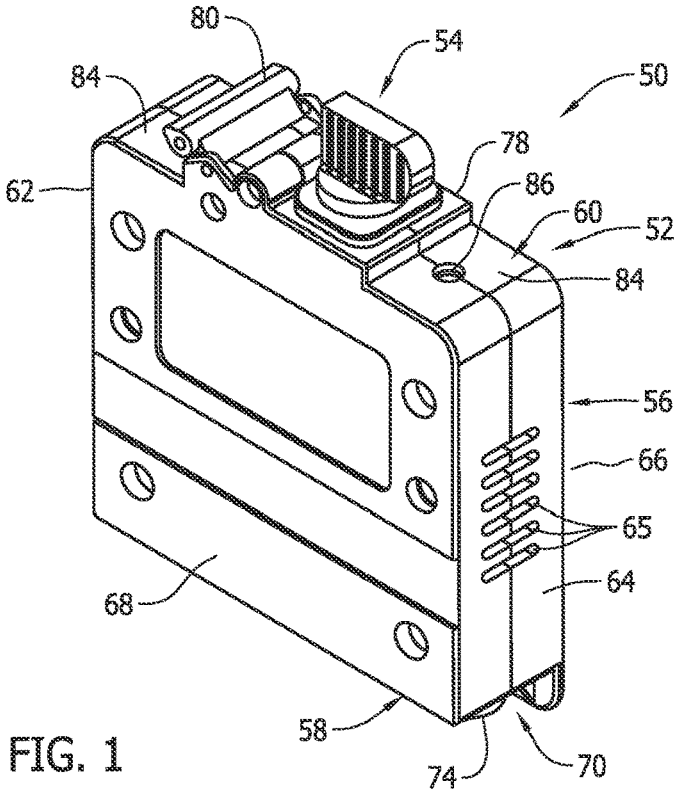
FIG. 1 is a perspective view of an exemplary fusible disconnect switch device formed in accordance with an embodiment of the present invention.

Compact fusible switching disconnect devices have been recently developed that advantageously combine switching capability and enhanced fusible protection in a single, compact housing. Such devices include Compact Circuit Protector (CCP) devices available from Bussmann by Eaton. As compared to conventional arrangements wherein fusible devices are connected in series with separately packaged switching elements, such fusible switching disconnect devices can provide substantial reduction in size and cost while providing comparable, if not superior, circuit protection performance.

When such compact fusible switching disconnect devices are utilized in panelboards, current interruption ratings of the board may be increased while the size of the panelboard may be simultaneously reduced. Such compact fusible disconnect devices also accommodate fuses without involving a separately provided fuse holder, and also establish electrical connection without fastening of the fuse to the line and load side terminals, and therefore provide still further benefits by eliminating certain components of conventional constructions and providing lower cost, yet easier to use fusible circuit protection products. While such compact fusible disconnect devices are superior in many ways to other known fusible disconnect assemblies, they still have yet to completely meet the needs of the marketplace and improvements are desired.

For example, in certain applications such as a power distribution system in a datacenter, increasing the power density of devices utilized is highly desired. Trends in the datacenter market are driving requirements for smaller circuit protection solutions with higher protection ratings, so increasing power density of circuit protection devices is top priority for datacenter manufacturers. Larger, conventional components have undesirable high material costs, occupy an undesirable amount of space in a shrinking server rack space, and block air flow through server racks.

As used herein, power density shall refer to the interrupting capability of the fusible circuit protection per unit volume of the fusible device. Compact fusible switching disconnect devices are known having, for example, a voltage rating of 600 VAC, 30 A, interrupting ratings of 200 kA, and a power density of about 2.1 kA/cm$^3$. While such current, voltage and interruption ratings may be sufficient for data center power distributions systems, the power density is not. Offering similar capabilities (i.e., similar ratings) in reduced package sizes to increase power density and meet the needs of data centers, however, presents practical challenges.

In particular, it would be desirable to provide compact fusible disconnect devices that are compatible with standard rack mounted power distribution units (PDUs) commonly found in datacenters. Known compact fusible disconnect devices are neither sized nor shaped to be compatible with standard rack mounted PDUs. In particular, known compact fusible disconnect devices are too large in certain dimensions to be used with standard rack mounted PDUs.

It would further be desirable to provide compact fusible disconnect devices that may be face mounted, for example, to a fuse panel in a telecommunications power distribution system. Known compact fusible disconnect devices, however, are generally incapable of accommodating such desired face mounting installation to a panel.

Exemplary embodiments of inventive compact fusible disconnect devices are accordingly described hereinbelow that address these and other difficulties in the art. The exemplary compact fusible disconnect devices of the invention are manufacturable in smaller package sizes that occupy a reduced amount of space, such that the compact fusible disconnect devices are compatible with standard rack mounted PDUs while nonetheless offering a voltage rating of 600 VAC, 30 A, and interrupting ratings of 200 kA. As such, the power density of the exemplary inventive compact fusible disconnect devices is substantially increased relative to known compact fusible disconnect devices of comparable voltage, current and interruption ratings.

The exemplary inventive compact fusible disconnect devices are further configured to accommodate face mounting to panel, as well as providing enhanced safety and convenience to allow fuses to removed and replaced without having to open the panel. Various terminal configurations are possible in the exemplary inventive compact fusible disconnect devices to simplify installation issues in various applications. The exemplary inventive compact fusible disconnect devices may also be advantageously provided with in-line ganged actuation mechanisms to effect simultaneous switching of a plurality of the compact fusible disconnect devices. These benefits are achieved at least in part via improved housing assemblies; improved fuse cover assemblies; improved terminal configuration placement and terminal options; and inventive ganging arrangement and actuation mechanisms. Method aspects will be in part explicitly discussed and in part apparent from the following description.

Figure 2:
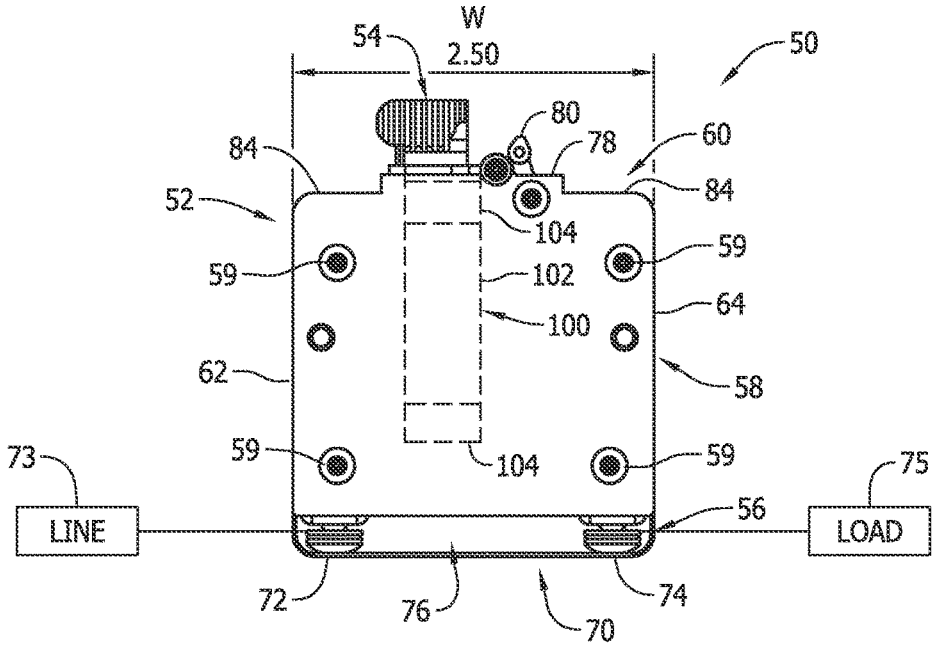
FIG. 2 is a first side elevational view of the exemplary fusible disconnect switch device shown in FIG. 1.
Figure 5:
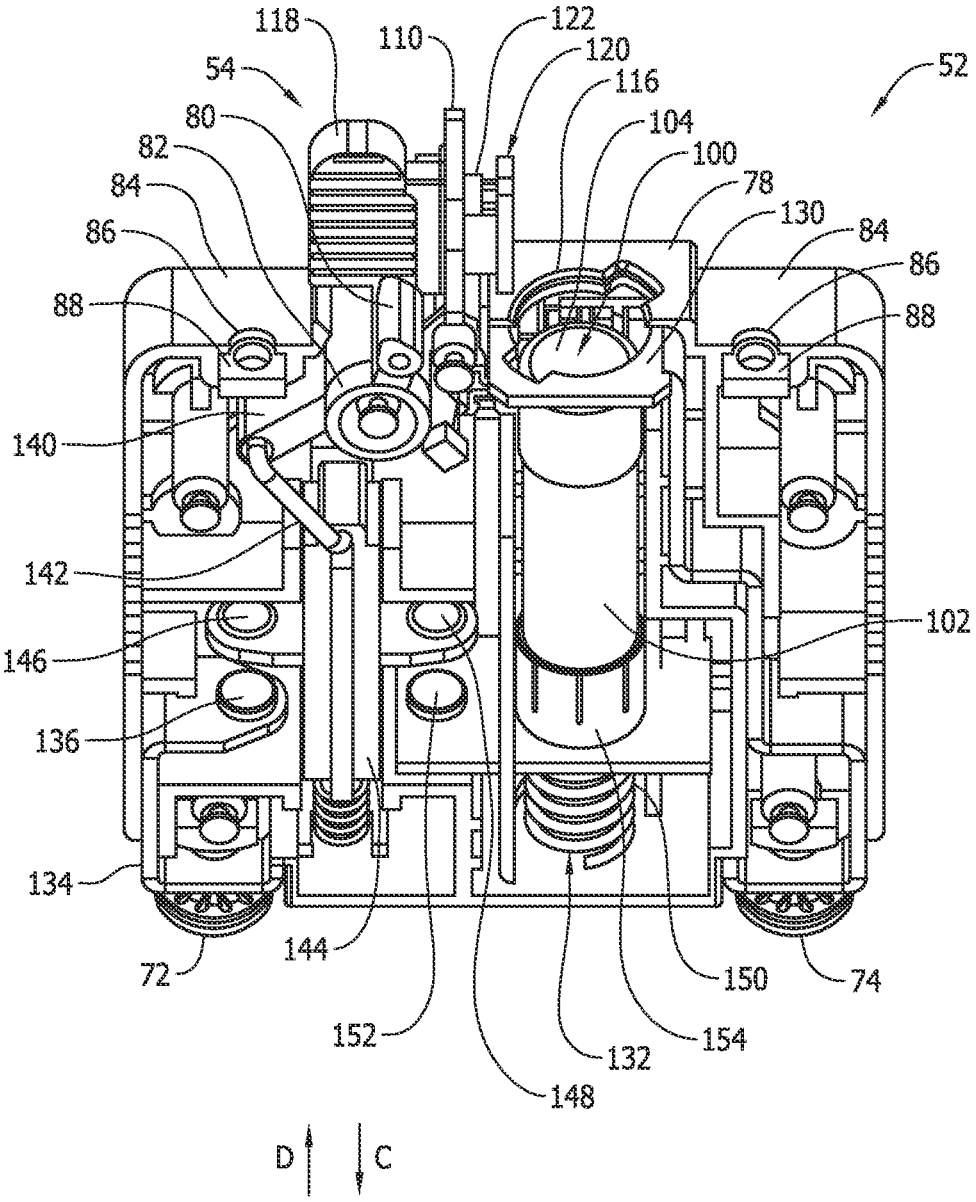
FIG. 5 is a partial perspective assembly view of the exemplary fusible disconnect switch device shown in FIGS. 1-4 revealing the internal construction thereof.

Referring now to the drawings, FIG. 1 is a side elevational view of an exemplary compact fusible disconnect switch device 50 including a nonconductive switch housing 52 configured or adapted to receive a cylindrical overcurrent protection fuse 100 (shown in phantom in FIG. 2 and in the assembly view of FIG. 5).

The fuse 100 is a known assembly including an elongated and typically nonconductive cylindrical housing 102, and a pair of terminal elements 104 in the form of conductive end caps or ferrules extending on the opposing ends of the cylindrical housing 102. A primary fuse element or fuse assembly is located within the cylindrical housing 102 and is electrically connected between the ferrule terminal elements 104. The primary fuse element or fuse assembly is, by design, configured to melt and open one or more circuits through the fuse to prevent electrical component damage when electrical current flowing through the fuse exceeds a predetermined limit. Once the fuse opens to interrupt the circuit, it must be replaced to restore the operation of the protected circuitry. The switch housing 52 includes a fuse cover assembly 54 described further below that may be operated to install the fuse 100, access the fuse 100 after it has been installed, as well as allow removal and replacement of the fuse 100 after it has opened.

In contemplated embodiments, the fuse 100 may be, for example, a Class G fuse having an ampacity rating of 15-30 A, or a Class CC or IEC Class gG aM fuse commercially available from Bussmann by Eaton as well as other fuse manufacturers. While several examples of cylindrical fuses 100 are described, still other fuses are possible and may be utilized in alternative embodiments. Also, while the exemplary embodiments of fusible disconnect switch devices depicted are configured to or adapted to receive a cylindrical fuse, other types and configurations of fuses are known and could be utilized in alternative embodiments while realizing at least some of the advantages described.

The switch housing 52 in the exemplary embodiment shown in the Figures is fabricated from a nonconductive or electrically insulative material such as plastic according to known techniques, and as shown in the illustrated example the switch housing includes a split case or split shell construction including a first housing piece 56 and a second housing piece 58 each defining about ½ of an enclosure as is best seen from FIG. 5. When the housing pieces 56 and 58 are coupled together using known fasteners 59 (FIG. 2), the housing pieces 56, 58 collectively define an enclosure for the internal components shown in FIGS. 5 and 7 described below.

In combination, the housing pieces 56, 58 collectively define a generally rectangular switch housing 52 having generally orthogonal sides including a front side or face 60, opposing lateral sides or faces 62, 64 each opposing lateral end of the front side or face 60, and opposing longitudinal sides or faces 66, 68 extending from the opposing longitudinal side edges of the front side or face 60. The lateral sides or faces 62, 64 are each formed with a series of elongated apertures 65 (FIG. 3) that serve to ventilate the switch housing 52 and dissipate heat in use.

Figure 3:
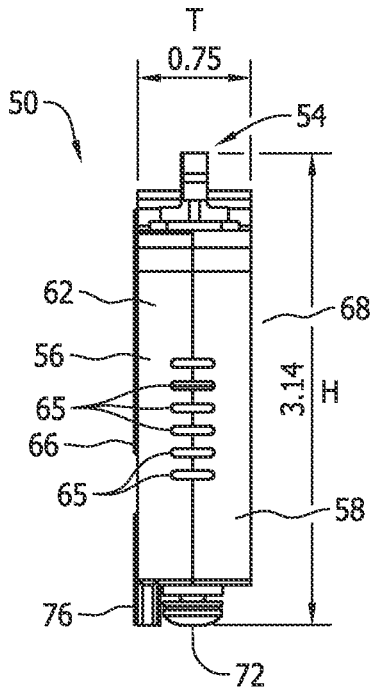
FIG. 3 is a second side elevational view of the exemplary fusible disconnect switch device shown in FIGS. 1 and 2.

Opposite the front side or face 60 in the switch housing 52 is a rear side or face 70. At the rear side or face 70 of the compact fusible disconnect device 50, the housing pieces 56, 58 are seen to be different from one another. Specifically, the housing piece 56 is larger in the vertical dimension than the housing piece 58 as seen in FIGS. 2 and 3. As a result, the longitudinal side wall 66 of the housing piece 56 is larger than the longitudinal side wall 68 of the housing piece 58, and accordingly a portion 76 of the longitudinal side wall 66 extends beyond the longitudinal side wall 68 at the rear side 70. As such, the housing pieces 56, 58 are asymmetrical in the embodiment shown.

The rear side or face 70 of the switch housing 52 includes spaced apart first and second terminals 72, 74 (FIG. 2) for establishing electrical connection to an external circuit. The terminals 72, 74 likewise extend forwardly on an interior side of the wall portion 76 as shown in FIG. 2 and extend downwardly from a lower edge of the longitudinal side wall 68 at the rear side 70 of the switch housing 52. Additionally, the terminals 72, 74 are positioned proximate the lateral sides 62, 64 and generally at the rear corners of the switch housing 52. As seen in FIG. 2, each terminal 72, 74 is a wire clamp terminal including a screw that can be advanced toward and away from the rear side 70 to provide a clearance to receive a line-side or load-side conductor such as a wire and to clamp the conductor in place to secure mechanical and electrical connection of the wire to each terminal 72, 74.

One of the first and second terminals 72, 74 of the compact fusible disconnect devices 50 serves as a line-side terminal and the other serves as a load side terminal. As shown in the example of FIG. 2, the terminal 72 may be connected to line-side circuitry 73 while the terminal 74 may be connected to load-side circuitry 75. The placement of the terminals 72, 74 facilitates a reduction in the size of the switch housing 52 relative to known compact fusible disconnect switch devices. In the device 50, both of the terminals 72, 74 are provided on the same side (i.e., the rear side) of the switch housing 52, and as such the switch housing 52 including the terminals 72, 74 on a common side of the switch housing 52 allows the switch housing 52 to be smaller relative to switch housings of conventional compact fusible disconnect devices wherein the line side terminal and the load side terminal are located on different sides of the switch housing. Relative to known and previously available Compact Circuit Protector (CCP) devices available from Bussmann by Eaton, the width W dimension is reduced substantially by providing the terminals 72, 74 on the bottom side 70 as opposed to the opposing lateral sides 62, 64 of the switch housing 52.

As seen in FIGS. 2 and 3, the switch housing 52 has an overall exterior width dimension W from lateral side 62 to lateral side 64 of about 2.5 inches (6.35 cm), an overall exterior height dimension H from the end of the wall portion 76 to the tip of the cover assembly 54 of about 3.14 inches (7.98 cm), and an overall thickness dimension & from longitudinal side 66 to longitudinal side 68 of about 0.75 inches (1.91 cm). As such, the switch housing 52 occupies an exterior volume of 5.88 $in^3$ or 96.36 $cm^3$ (the product of H, W and T dimensions). This size is compatible with space available in standard rack mounted PDUs, and is considerably less than conventional compact fusible disconnect devices.

Figure 4:
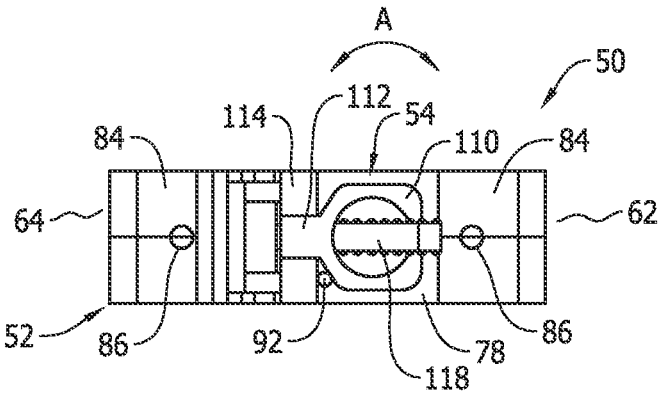
FIG. 4 is a front view of the exemplary fusible disconnect switch device shown in FIGS. 1-3.

As best seen in FIGS. 1, 4 and 5, the front side or face 60 of the switch housing 52 includes a slightly elevated surface portion 78 upon which the fuse cover assembly 54 extends, and also from which a handle portion 80 of a switch actuator 82 (FIG. 5) projects. Depressed on non-elevated surface portions 84 extend in a co-planar relationship on either side of the elevated surface 78. By virtue of the slightly elevated surface portion 78, the front side or face 60 has a slightly stepped contour. As seem in FIG. 2, the difference in elevation of the elevated surface portion 78 and the non-elevated surface portions 84 is small to facilitate face mount installation as described below as well as to reduce the height dimension H of the switch housing 52. Relative to known compact fusible disconnect devices, and in particular relative to previously existing and available Compact Circuit Protector (CCP) devices available from Bussmann by Eaton, the difference in elevation of the elevated surface portion 78 and the non-elevated surface portions 84 is much less pronounced and the switch housing 52 is accordingly reduced substantially in height. As such, the compact fusible disconnect device 50 is sometimes referred to as a low profile compact fusible disconnect device.

Figure 8:
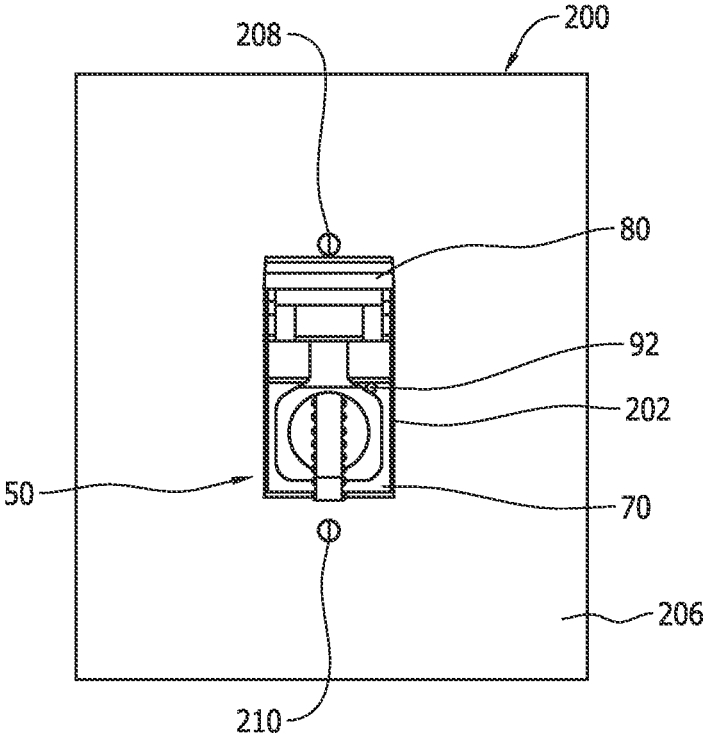
FIG. 8 is a front view of an embodiment of fusible disconnect switch device formed in accordance with an embodiment of the present invention in a panel mounted installation.
Figure 9:
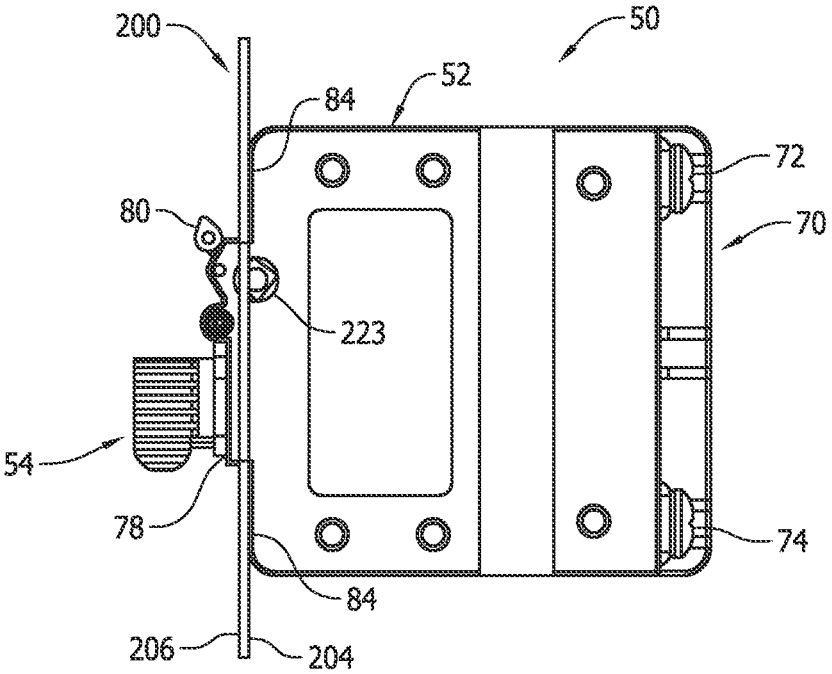
FIG. 9 is a side elevational view of the panel mounted fusible disconnect switch device shown in FIG. 8.

Each of the depressed or non-elevated surface portions 84 on the front side 60 of the switch housing 52 includes an aperture 86 and an anchor element 88 as best shown in FIG. 5. When desired, the switch housing 52 can be face mounted to a panel 200 (FIG. 8) including a cutout portion or aperture 202. The non-elevated surface portions 84 may be brought into contact with a first major side surface 204 of the panel 200 as shown in FIG. 9, and the elevated surface portion 78 is extended through the cutout portion 202 and projects from the second major side surface 206 of the panel 200. Fasteners 208, 210 such as screws are inserted through corresponding apertures in the panel 200 and also are inserted through the apertures 86 in the switch housing 52 to engage the anchor elements 88 that may be for example, threaded nuts. When the fasteners are tightened, the device 50 is face mounted to the panel 200 with a portion of the front side 60 of the switch housing 52 (namely the elevated surface portion 78, the cover assembly 54 and the switch actuator handle portion 80) extending slightly from the front side 206 of the panel 200 and the reminder of the switch housing 52 of the device 50 extending from the rear side 204 of the panel 200. In this arrangement, fuses 100 can advantageously be installed and removed by operating the fuse cover assembly 54 from the front side of the panel 200, without having to open the panel 200. Likewise, the handle portion 80 of the switch actuator may also be operated from the front side of the panel 200, without having to open the panel 200. An enhanced degree of safety is provided when operating the device 50. The panel 200 may be configured as a deadfront panel to provide still further safety assurance.

Figure 7:
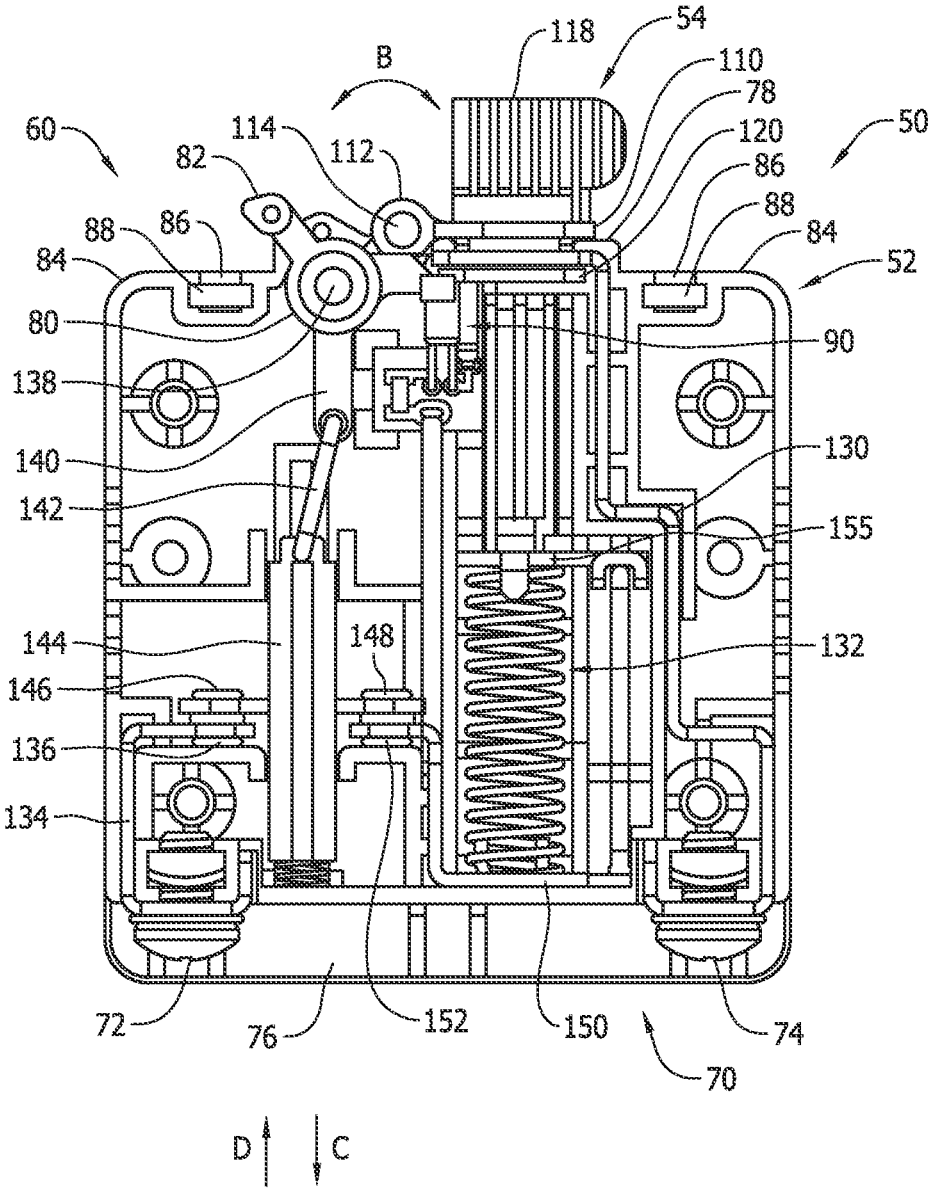
FIG. 7 is a partial side assembly view of another embodiment of a fusible disconnect switch device revealing the internal construction thereof.

As best seen in FIG. 7, the switch housing 52 of the device 50 may optionally include a fuse state indicator 90 in the form of a neon tube that may illuminate when the fuse 100 has opened and needs replacement. The illumination from the fuse state indicator 90 is visible through an aperture 92 (also shown in FIG. 8) formed through the elevated surface portion 78 of the switch housing front side 60 and as such is visible from the front side 60 when the switch housing 52 is face mounted to the panel 200. As such, the operating state of the fuse 100 as opened or unopened can be readily determined by visual inspection of the indicator 90 from the front side of the panel 200, without having to open the panel 200. The fuse state indicator 90 may be illuminated in response to, for example, detected current or voltage conditions, mechanical actuation by a striker element included in the fuse 100 when the fuse element opens, or in another manner known in the art. While a neon tube is one example of a fuse state indicator 90, other types of fuse state indicator elements are possible and may be utilized.

As best shown in FIGS. 4, 5, and 7, the fuse cover assembly 54 in the exemplary embodiment depicted includes a nonconductive and generally planar cover portion 110 formed integrally with a sleeve 112 that is rotatable on a shaft 114 that is integrally formed on the front side 60 of the switch housing 52. The cover portion 110 as shown is generally rectangular and is dimensioned to cover a non-rectangular fuse insertion aperture 116 (FIG. 5) formed through the front side 60 of the switch housing 52. A nonconductive handle portion 118 is rotatably mounted to the front side of the cover portion 110 and is configured with a finger grip extending generally perpendicular to a plane of the cover portion 110. A conductive fuse contact member 120 (FIG. 5) is coupled stationary to the handle portion 118 and extends on the rear side of the cover portion 110.

The conductive contact member 120 includes a leading end that is shaped complementary to the fuse insertion aperture 116 which in the example shown is generally circular with a pair of keyed slots. As such, the leading end of the conductive contact member 120 includes a generally circular periphery as seen in FIG. 5 with a pair of protruding keyed ribs extending outwardly therefrom. In this arrangement, the handle portion 118 must be rotated in the direction of arrow A (FIG. 4) about a first rotational axis in that is perpendicular to the cover portion 110 to rotate the attached fuse contact member 120 and align the ribs with the slots in order for the handle assembly to be moved from a closed position (FIG. 7) to an opened position (FIG. 5) or vice versa. With the keyed ribs and keyed slots aligned, the cover portion 110 and the attached handle portion 118 and fuse contact member 120 may then be rotated about the shaft 114 via the sleeve 112 in the direction of arrow B (FIG. 7) about a second rotational axis that extends parallel to the handle portion 118 to insert the fuse contact member 120 through the fuse insertion aperture 116 or remove it from the fuse insertion aperture 116. If the keyed ribs and slots are not aligned, the fuse contact member 120 cannot be inserted or removed and the handle assembly is prevented from opening or closing as the case may be.

In the closed position (FIG. 7), the fuse contact element 120 of the handle assembly 54 is retained in mechanical and electrical contact with a load-side fuse terminal contact 130 that underlies the fuse insertion aperture 116 and completes an electrical connection with the terminal 74 and the fuse contact element 120 also is retained in surface contact with the adjacent ferrule 104. The mechanical and electrical connection with the fuse contact element 120 of the handle assembly 54 is ensured by a spring loaded plunger arrangement 132 acting on the opposing ferrule 104 of the fuse 100 when the fuse 100 is installed. FIGS. 5 and 7 show two alternate arrangements of the spring loaded plunger arrangement 132 in otherwise similar devices as further described below. In either case, the spring loaded plunger arrangement 132 serves to establish a contact force between the fuse contact element 120 of the handle assembly 54 and the fuse terminal contact element 130 while the cover assembly 54 is in the closed position. When the cover assembly 54 is in the open position, however, stored energy in spring is released to electrically isolate and forcibly eject the fuse 100 from the switch housing 52.

The switch housing 52 as shown in FIGS. 5 and 7 further includes a line-side contact 134 with the terminal 72 attached at one end and a stationary switch contact 136 at the other end. The rotary switch actuator 82 is further provided on the switch housing 52. The rotary switch actuator 82 is formed as a generally cylindrical (i.e., round) element that is rotatable on a shaft 138 (FIG. 7) formed in the switch housing 52. The rotary switch actuator 82 further includes the handle portion 80 extending radially outwardly therefrom and a switch extension 140 integrally formed therewith and extending radially outwardly therefrom. The switch extension 140 extends obliquely to the handle portion 80, and an actuator link 142 is coupled to an end of the switch extension 140. The switch extension 140 extends the effective radius of the rotary switch actuator 82 and improves mechanical leverage for operating the switch mechanism with the link 142 as described next.

The actuator link 142 is coupled on its opposing end to a sliding actuator bar 144. The actuator bar 144 carries a pair of switch contacts 146 and 148. An intermediate contact member 150 is also provided including a stationary contact 152 is also provided. The intermediate contact member 150 operates as a line-side fuse contact in the switch housing that electrically connects to the lower fuse ferrule 104 when the fuse 100 is installed. As described above, electrical connection to power supply circuitry may be accomplished in a known manner using the terminal 72, and electrical connection to load side circuitry may be accomplished in a known manner using the load side terminal 74.

Disconnect switching may be accomplished by rotating the switch actuator 82 about the shaft 138 via the handle portion 80, causing the actuator link 142 to move the sliding bar 144 linearly in the direction of arrow C and moving the switch contacts 146 and 148 toward the stationary contacts 136 and 152. Eventually, the switch contacts 146 and 148 become mechanically and electrically engaged to the stationary contacts 136 and 152 and a circuit path may be closed through the fuse 100 between the ferrules 104 when the fuse 100 is installed in the switch housing 52. The closed circuit path is illustrated in the example of FIG. 7 wherein the handle portion 80 extends away from the fuse cover assembly 54.

Figure 6:
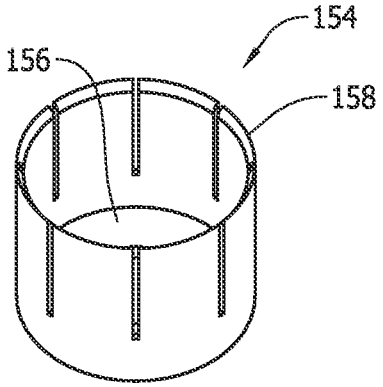
FIG. 6 is a perspective view of an exemplary fuse contact member for the exemplary fusible disconnect switch device shown in FIG. 5.

In the embodiment of FIG. 5, the intermediate contact member 150 is formed as a planar contact and includes a contact sleeve 154 (shown separately in FIG. 6). Relative to the embodiment shown in FIG. 7 including a second plate contact 155, the contact sleeve 154 in combination with the configuration of the other contacts provides increased thermal performance by reducing an electrical resistance along the conducting path through the fuse 100 in the device 50. The contact sleeve 154 includes flat base 156 and a cylindrical side 158 formed with vertical slots and hence defining a number of contact fingers to establish electrical connection with the end and side surfaces of the fuse ferrule 104. The increased surface contact with the fuse ferrule 104 made possible by the contact sleeve 154 decreases resistance of the current path relative to the embodiment of FIG. 7 wherein the current path includes a wire braid to establish electrical connection between the intermediate contact plate 150 and the second contact plate 155. The decreased resistance of the path in the embodiment of FIG. 5, in turn, allows the assembly to run cooler and reduces watts loss. The configuration of contacts shown in FIG. 5 also shortens the conducting path length, reduces the number of joints, and eliminates certain thermal conductivity issues presented by the embodiment of FIG. 7. The embodiment of FIG. 7, however, may be utilized in less demanding applications with otherwise similar functionality.

In the embodiment of FIG. 5, the spring loaded plunger 132 acts from beneath the intermediate contact 150 and extends through the center of the sleeve contact 154 to eject the fuse in the direction of Arrow D when the fuse cover assembly 54 is opened. In the embodiment of FIG. 7, the spring loaded plunger 132 acts from above the intermediate contact 150 to eject the fuse in the direction of Arrow D when the fuse cover assembly 54 is opened. Either way, the fuse 100 is electrically isolated as it is ejected so that the fuse 100 is touch safe (i.e., may be safely handled by hand without risk of electrical shock) when installing and removing the fuse 100 from the switch housing 52.

When the actuator 82 is moved in the opposite direction via the handle portion 80 as shown in the example of FIG. 5, the actuator link 142 causes the sliding bar 144 to move linearly in the direction of arrow D and pull the switch contacts 146 and 148 away from the stationary contacts 136 and 152 to open the circuit path through the fuse 100. As such, by moving the actuator 82 to a desired position, the fuse 100 and associated load side circuitry 75 may be connected and disconnected from the line side circuitry 73 while the line side circuitry 73 remains "live" in full power operation. Electrical arcing that may occur when connecting/disconnecting the circuit path via the switch contacts 146, 148 may be safely contained interior to the switch housing 52. Arcing intensity is divided over two sets of switch contacts rather than one as in some conventional disconnect devices. The switching mechanism and arrangement described utilizing a linearly sliding switch mechanism provides a compact, yet highly effective switching capability that further facilitates a reduction in size of the switch housing 52.

Table 1 below sets forth a relative comparison of attributes of the compact fusible disconnect device 50 in relation to other known conventional devices. In Table 1, the device 50 is denoted as "LP-CCP".

TABLE 1

| P/N | Manufacturer | Volume ($cm^3$) | Max Voltage (V) | Max Amps (A) | SCCR Fully Rated (kA) | Max Voltage/ Volume ($V/cm^3$) | SCCR/ Volume ($kA/cm^3$) |
|---|---|---|---|---|---|---|---|
| LP-CCP | Bussmann | 70.58 | 600 | 30 | 200 | 8.5 | 2.8 |
| CCP | Bussmann | 95.09 | 600 | 30 | 200 | 6.3 | 2.1 |
| Circuit Breaker | Carling | 77.76 | 240 | 30 | 10 | 3.1 | 0.1 |
| OPTIMA Holder | Bussmann | 162.37 | 600 | 30 | 100 | 3.7 | 0.6 |
| 30A Rotary Disconnect | Bussmann | 929.86 | 600 | 30 | 100 | 1.0 | 0.1 |

It is seen from Table 1 that the LP-CCP device 50 offers similar or higher voltage and current ratings than the prior devices while having a reduced volume and increased power density. Substantial increases in maximum voltage per unit volume and short circuit current rating per unit volume are demonstrated in Table 1.

Table 2 below sets forth a further relative comparison of specifications of the compact fusible disconnect device 50 in relation to one of the devices shown in Table 1, namely the circuit breaker device (Carling) that is the closest in volume to the compact fusible disconnect device 50. In Table 2, the device 50 is again denoted as "LP-CCP".

TABLE 2

| Specification | Carling C62 | LP-CCP |
|---|---|---|
| UL Voltage | 240 Vac | 600 Vac |
| SCCR | 5,000 A | 200,000 A |
| Fusible | No | Yes |
| Selective Coordination | No | Yes |

The voltage and short circuit current rating (SCCR) capabilities of the two devices in Table 2 are starkly different, and as shown in Table 2 the compact fusible disconnect device 50 advantageously facilitates selective coordination of loads, while the circuit breaker device does not.

Figure 10:
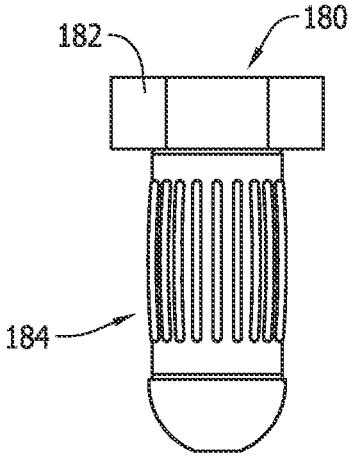
FIG. 10 illustrates a first terminal configuration for the fusible disconnect switch devices shown in FIGS. 1-9.
Figure 11:
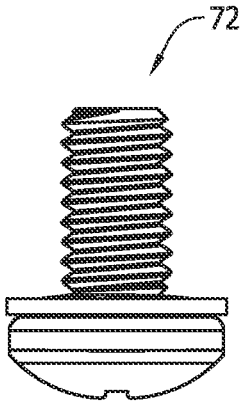
FIG. 11 illustrates a second terminal configuration for the fusible disconnect switch devices shown in FIGS. 1, 6 and 8.

FIG. 10 illustrates an alternative terminal configuration 180 that may be used with the switch housing 52 described above. The terminal configuration 180 includes a base 182 that may be fastened to the switch housing 52 and connected to the terminal contact 130 or 134 discussed above. A cylindrical contact element 184 may extend from the base, and in the example shown in FIG. 10 the contact element 184 may be recognized as a so-called bullet contact that may be connected to line and load side circuitry with plug-in connection that does not require tools to complete a connection. In comparison to the terminal 72 shown in FIG. 11 that requires a screwdriver to complete a connection, the bullet contact element 184 of the terminal configuration 184 may provide considerably simpler installation in some applications.

Figure 12:
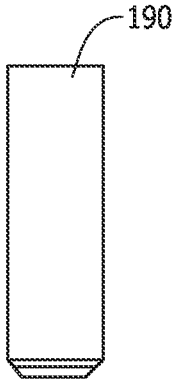
FIG. 12 illustrates a third alternative terminal configuration for the fusible disconnect switch devices shown in FIGS. 1, 6 and 8.

FIG. 12 illustrates another terminal configuration 190 in the form of a contact blade. Like the bullet contact configuration, the terminal blade may be connected to line and load side circuitry with plug-in connection that does not require tools to complete a connection with line and load side circuitry and accordingly provides simplified use in relation to the terminal 72.

While exemplary terminal configurations have been described, other terminal configurations are possible and may be utilized in further alternative embodiments.

When compact fusible disconnect switch devices 50 are used in branch circuitry of a power distribution system, it is required that all the branch disconnect devices operate together. Accordingly, FIGS. 13-15 illustrate exemplary ganged actuation arrangements for the compact fusible disconnect switch devices 50.

Figure 13:
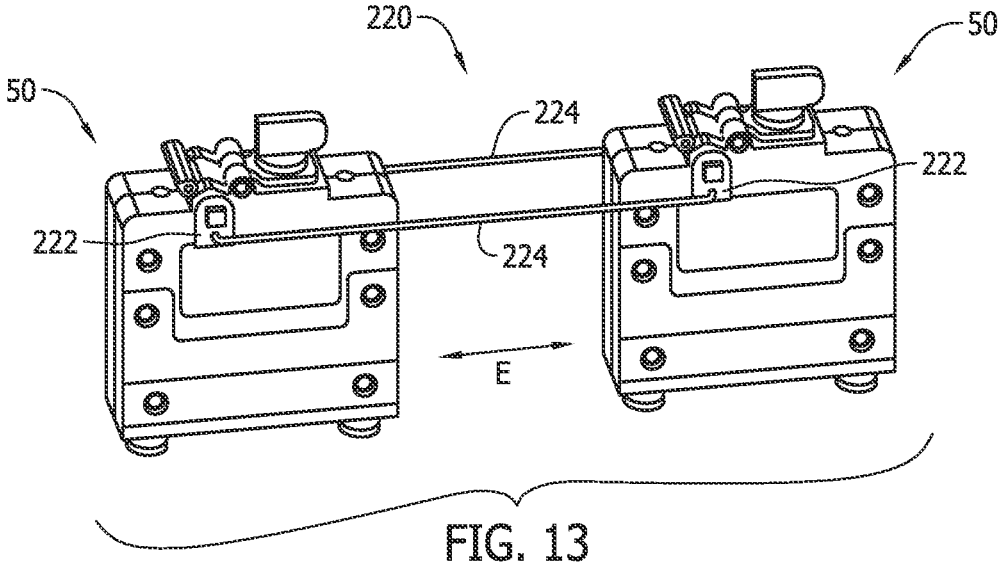
FIG. 13 illustrates a first in-line ganging mechanism for the fusible disconnect switch devices shown in FIGS. 1, 6 and 8.
Figure 14:
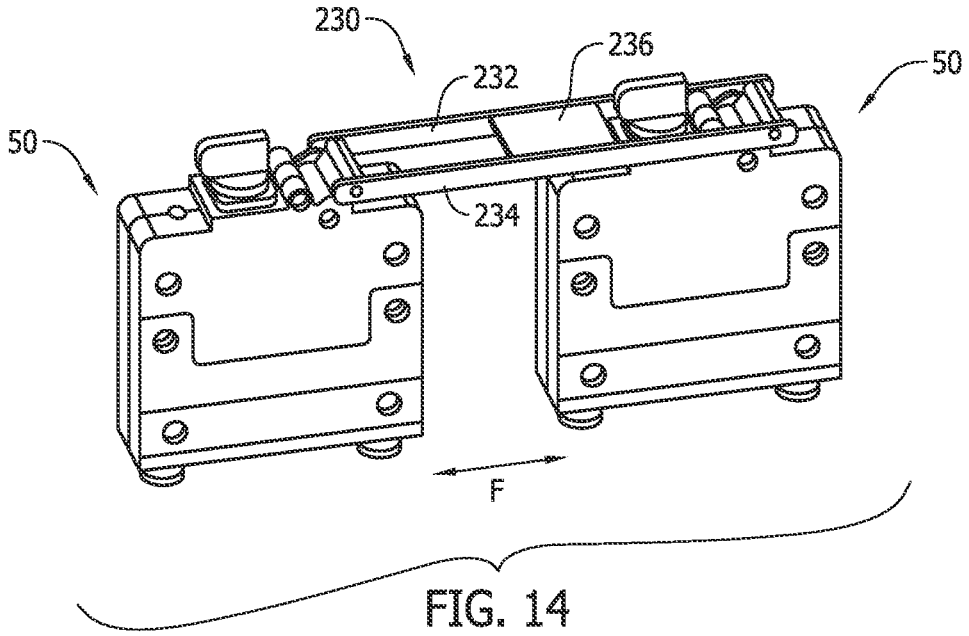
FIG. 14 illustrates a second in-line ganging mechanism for the fusible disconnect switch devices shown in FIGS. 1, 6 and 8.
Figure 15:
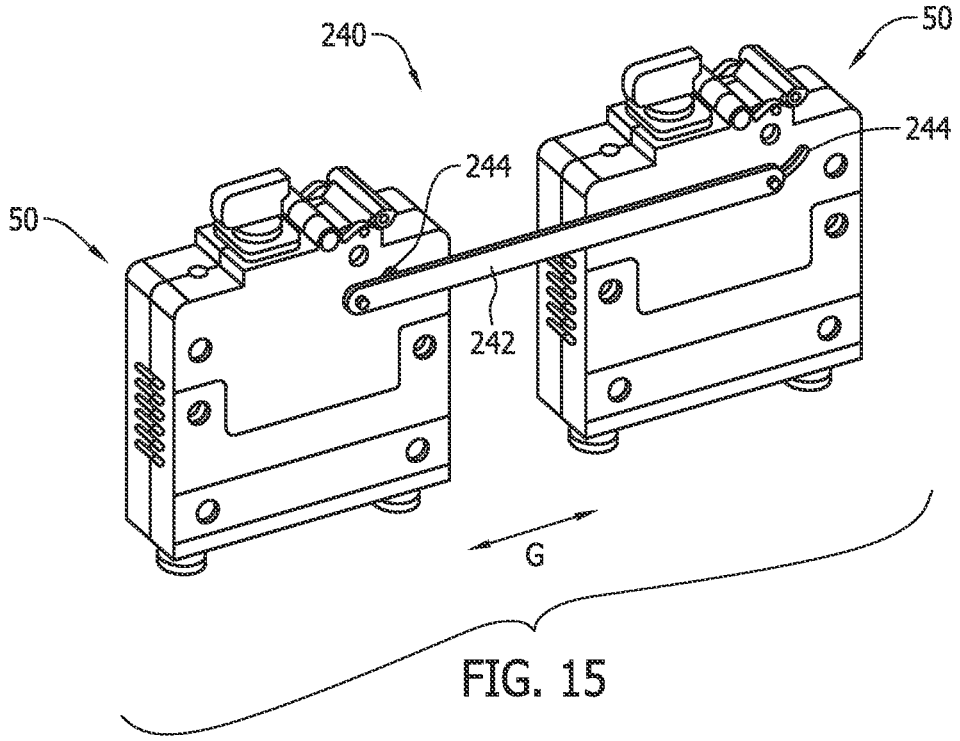
FIG. 15 illustrates a third in-line ganging mechanism for the fusible disconnect switch devices shown in FIGS. 1, 6 and 8.

Unlike known compact fusible disconnect switch devices wherein switch devices are ganged laterally or side-by-side to provide multiple pole switching, the devices 50 may be ganged longitudinally or in an in-line configuration as shown in FIGS. 13-15. In each arrangement shown, ganged, simultaneous operation is possible without affecting the thickness dimension T (FIG. 3) of the assembly.

In FIG. 13, a first a first in-line ganging mechanism 220 is shown including fusible disconnect switch devices 50. In the mechanism 220, a set of plates 222 is provided that respectively mechanically couples to and interfaces with the rotary switch actuator 82 described above via, for example, actuator apertures 223 (FIG. 9) formed in the longitudinal sides of the switch housing 52 in each device 50. One pair of plates 222 is provided on each switch housing 52 in each device 50. A pair of rods 224 connects one of the plates 222 of one of the devices 50 to one of the plates 222 of the other device 50. The ends of each rod 224 are pivotally coupled to each plate 222 such that when the rod(s) 224 are moved linearly in the direction of arrow E they cause the plates 222 to pivot in the same direction and at the same rate, which in turn causes the rotary actuator 82 in each device 50 to pivot in the same direction and at the same rate and open or close the circuit path in each device 50 as described above. Simultaneous switching is provided in each of the devices 50 by pulling the rods in the direction of arrow E.

While two rods 224 and two sets of plates 222 are shown, similar switching could be accomplished using only one of the rods 224 and two sets of plates 222. Also, while FIG. 13 shows two devices 50 in a two pole ganged arrangement, more than two devices 50 could likewise be ganged and simultaneously switched by providing additional plates 222 and rods 224. Also, while exemplary plates 222 and rods 224 are shown in FIG. 13, other mechanical linkages besides plates and rods could alternatively be provided to effect similar functionality.

FIG. 14 illustrates a second in-line ganging mechanism 230 including fusible disconnect switch devices 50. In the mechanism 230, parallel elongated plates 232, 234 are provided that respectively mechanically couple to and interface with the handle portion 80 of the rotary switch actuator 82 described above. Opposing ends of the plates 232, 234 are fastened to each of the handle portions 80 using a known fastener, and a connecting plate 236 may be provided to interconnect the elongated plates 232, 234 for improved structural strength and rigidity. The ends of each plate 224 are pivotally coupled to each handle portion 80 such that when the plates 232, 234 are moved linearly in the direction of arrow F they cause the handle portions 80 to pivot, which in turn causes the rotary actuator 82 in each device 50 to pivot and open or close the circuit path in each device 50 as described above. Simultaneous switching is provided in each of the devices 50 by pulling the plates 232, 234 in the direction of arrow E.

While two elongated plates 232, 234 are shown, similar switching could be accomplished using only one of the elongated plates 232 or 234. Also, while FIG. 14 shows two devices 50 in a two pole ganged arrangement, more than two devices 50 could likewise be ganged and simultaneously switched by providing additional plates 232, 234. Also, while exemplary elongated plates 232, 234 are shown in FIG. 14, other mechanical linkages are possible and could alternatively be provided to effect similar functionality.

FIG. 15 illustrates a third in-line ganging mechanism 240 including fusible disconnect switch devices 50. In the mechanism 240, an elongated plate 242 is provided that respectively mechanically couples to and interfaces with the switch extension 140 (FIGS. 5 and 7) of the rotary switch actuator 82 described above. Opposing ends of the plate 242 are fastened to the switch extension 140 using a known fastener. The ends of the plate 242 are pivotally coupled to each switch extension such that when the plate 242 is moved linearly in the direction of arrow G the switch extensions 140 are caused to rotate, which in turn causes the rotary actuator 82 in each device 50 to pivot and open or close the circuit path in each device 50 as described above. Simultaneous switching is provided in each of the devices 50 by pulling the plates 242 in the direction of arrow G. Arcuate guide slots 244 are formed in the side of each switch housing 52 in each device 50 to accomplish the rotation of the switch extension 140 in each device.

While a single plate 242 is shown in FIG. 15, another plate could be provided to extend in parallel to the plate 242 as in the embodiments shown in FIGS. 13 and 14. Also, while FIG. 15 shows two devices 50 in a two pole ganged arrangement, more than two devices 50 could likewise be ganged and simultaneously switched by providing additional plates 242 or a longer plate 242 that may extend to connect more than two switch extensions 140 in the devices 50. Also, while an exemplary plate 242 is shown in FIG. 15, other mechanical links are possible and could alternatively be provided to effect similar functionality.

The benefits and advantages of the inventive concepts are now believed to have been amply illustrated in relation to the exemplary embodiments disclosed.

An embodiment of a fusible disconnect switch device has been disclosed including: a nonconductive switch housing including a plurality of orthogonal sides and configured to accept an overcurrent protection fuse; a first fuse contact member and a second fuse contact member in the nonconductive switch housing and configured to complete an electrical connection through the overcurrent protection fuse; at least one movable switch contact in the nonconductive switch housing to connect or disconnect the electrical connection through the fuse; a rotary actuator configured to move the at least one switch contact between opened and closed positions; and a line-side terminal and a load-side terminal provided on a common one of the plurality of orthogonal sides.

Optionally, one of the plurality of orthogonal sides may be configured to face mount the switch housing to a panel. One of the plurality of orthogonal sides may include an elevated surface portion, and the rotary actuator may include a handle portion projecting from the elevated surface portion.

One of the plurality of orthogonal sides may also include a fuse cover assembly. The fuse cover assembly may include a cover element rotatable about a first rotational axis, and a handle element mounted to the cover element. The handle element may be rotatable relative to the cover element about a second rotational axis. The second rotational axis may be perpendicular to the first rotational axis. The fuse cover assembly may also include a conductive contact attached to the handle element. The conductive contact may be configured with at least one keyed rib. The line-side terminal and load-side terminal include one of a wire clamp terminal, a bullet contact, and a terminal blade.

The plurality of orthogonal sides may include at least one side that is larger than a second side opposing the first side. A contact sleeve may be provided that is adapted to receive a terminal element of the overcurrent protection fuse. The terminal element of the overcurrent protection fuse may be a ferrule. The overcurrent protection fuse may be a cylindrical fuse. A fuse state indicator may be provided in the switch housing. The fuse state indicator may be a neon tube.

The fusible switch disconnect device may optionally also include at least one in-line ganging link. The at least one in-line ganging link may be coupled to the rotary actuator. Linear movement of the at least one ganging link may cause rotation of the rotary actuator.

The rotary switch actuator includes a round body and a switch extension extending radially from the round body internal to the switch housing, the at least one ganging link coupled to the switch extension. The rotary actuator may include a round body and a handle portion projecting outwardly from and exterior the switch housing, and the at least one ganging link may be coupled to the handle portion. The at least one ganging link may include at least one of a rod and a plate.

An embodiment of a fusible disconnect switch device has also been disclosed including: a nonconductive switch housing configured to accept a cylindrical overcurrent protection fuse, the nonconductive housing comprising a front side and a rear side opposing the front side; a first fuse contact member and a second fuse contact member in the nonconductive switch housing and configured to complete an electrical connection through the overcurrent protection fuse; at least one movable switch contact in the nonconductive switch housing to connect or disconnect the electrical connection through the fuse; a rotary actuator configured to move the at least one switch contact between opened and closed positions; and a line-side terminal and a load-side terminal provided on the rear side.

Optionally, the front side is configured to face mount the switch housing to a panel. The front side may include an elevated surface portion, and the rotary actuator may include a handle portion projecting from the elevated surface portion. A fuse cover assembly may extend on the elevated surface portion. The fuse cover assembly may include a cover element rotatable about a first rotational axis, and a handle element mounted to the cover element. The handle element may be rotatable relative to the cover element about a second rotational axis. The second rotational axis may be perpendicular to the first rotational axis. The fuse cover assembly may further include a conductive contact attached to the handle element. The conductive contact may be configured with at least one keyed rib.

The line-side terminal and load-side terminal may include one of a wire clamp terminal, a bullet contact, and a terminal blade. The switch housing may include a first longitudinal side and a second longitudinal side opposing the first longitudinal side, wherein the first longitudinal side is larger than the second longitudinal side. A contact sleeve may be provided and adapted to receive a terminal element of the overcurrent protection fuse. The terminal element of the overcurrent protection fuse may be a ferrule.

The fusible switch disconnect device may be in combination with at least one in-line ganging link. The at least one in-line ganging link may be coupled to the rotary switch actuator. Linear movement of the at least one ganging link causes rotation of the rotary switch actuator. The rotary actuator may include a round body and a switch extension extending radially from the round body internal to the switch housing, with the ganging link coupled to the switch extension. The rotary actuator may include a round body and a handle portion projecting outwardly from and exterior the switch housing, with the ganging link coupled to the handle portion. The at least one ganging link may include at least one of a rod and a plate.

An embodiment of a low profile fusible disconnect switch device has been disclosed including: a nonconductive switch housing configured to accept a cylindrical overcurrent protection fuse, the nonconductive housing comprising a front side and a rear side opposing the front side; a fuse cover assembly on the front side and movable between opened and closed positions to permit or deny access to the cylindrical overcurrent protection fuse; a first fuse contact member and a second fuse contact member in the nonconductive switch housing and configured to complete an electrical connection through the overcurrent protection fuse; at least one movable switch contact in the nonconductive switch housing to connect or disconnect the electrical connection through the fuse; and a rotary actuator configured to move the at least one switch contact between opened and closed positions; wherein the front side of the switch housing includes an elevated surface portion; wherein the handle assembly extends on the elevated surface portion; wherein the rotary actuator comprises a handle portion projecting the elevated surface portion; and wherein the front side is configured to be face mounted to a panel with the elevated surface portion extending on a first major side of the panel while the remainder of the switch housing extends on a second major side surface of the panel opposite the first major side surface.

Optionally, the low profile fusible switch disconnect device may also include a line-side terminal and a load-side terminal provided on the rear side. The fuse cover assembly may include a cover element rotatable about a first rotational axis, and a contact element rotatable about a second rotational axis substantially perpendicular to the first rotational axis.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fusible disconnect switch device comprising:

a nonconductive switch housing including a plurality of orthogonal sides and configured to removably accept a cylindrical overcurrent protection fuse;

a first fuse contact member and a second fuse contact member coupled to the nonconductive switch housing, each of the first fuse contact member and the second fuse contact member configured to engage and complete an electrical connection through the overcurrent protection fuse, wherein the first fuse contact member is rotatably mounted to the nonconductive switch housing and selectively positionable with respect to the overcurrent protection fuse, and the first fuse contact member comprises a planar conductive contact having a circular periphery and a pair of protruding keyed ribs extending from the circular periphery;

at least one movable switch contact in the nonconductive switch housing and positionable between open and closed positions to respectively connect or disconnect the electrical connection through the overcurrent protection fuse while the fuse is engaged to the first fuse contact member and the second fuse contact member;

a rotary actuator coupled to the nonconductive switch housing and configured to move the at least one movable switch contact between the opened and closed positions; and a line-side terminal and a load-side terminal exposed on and accessible from a common one of the plurality of orthogonal sides to establish an electrical connection to an external circuit.

2. The fusible disconnect switch device of claim 1, wherein one of the plurality of orthogonal sides is configured to face mount the nonconductive switch housing to a panel.

3. The fusible disconnect switch device of claim 2, wherein the one of the plurality of orthogonal sides comprises an elevated surface portion, and wherein the rotary actuator comprises a handle portion projecting from the elevated surface portion.

4. The fusible disconnect switch device of claim 1, wherein one of the plurality of orthogonal sides includes a fuse cover assembly.

5. The fusible disconnect switch device of claim 4, wherein the fuse cover assembly includes a cover element rotatable about a first rotational axis, and a handle element mounted to the cover element.

6. The fusible disconnect switch device of claim 5, wherein the handle element is rotatable relative to the cover element about a second rotational axis.

7. The fusible disconnect switch device of claim 6, wherein the second rotational axis is perpendicular to the first rotational axis.

8. The fusible disconnect switch device of claim 5, wherein the first fuse contact member is attached to the handle element.

9. The fusible disconnect switch device of claim 4, wherein the line-side terminal and load-side terminal respectively include one of a wire clamp terminal, a bullet contact, or a terminal blade.

10. The fusible switch disconnect device of claim 1, wherein the plurality of orthogonal sides includes a first side-and a second side opposing the first side with the cylindrical fuse being removably accepted between, wherein the first side is larger than the second side opposing the first side.

11. The fusible switch disconnect device of claim 1, wherein the second fuse contact member comprises a contact sleeve adapted to receive a terminal element of the cylindrical overcurrent protection fuse.

12. The fusible switch disconnect device of claim 11, wherein the terminal element of the cylindrical overcurrent protection fuse comprises a ferrule.

13. The fusible switch disconnect device of claim 1, further comprising a fuse state indicator in the nonconductive switch housing.

14. The fusible switch disconnect device of claim 13, wherein the fuse state indicator is a neon tube.

15. The fusible switch disconnect device of claim 1, further comprising at least one in-line ganging link.

16. The fusible switch disconnect device of claim 15, wherein the at least one in-line ganging link is coupled to the rotary actuator.

17. The fusible switch disconnect device of claim 16, wherein linear movement of the at least one in-line ganging link causes rotation of the rotary actuator.

18. The fusible switch disconnect device of claim 16, wherein the rotary switch actuator includes a round body and a switch extension extending radially from the round body internal to the nonconductive switch housing, the at least one in-line ganging link coupled to the switch extension.

19. The fusible switch disconnect device of claim 16, wherein the rotary actuator includes a round body and a handle portion projecting outwardly from and exterior to the nonconductive switch housing, the at least one in-line ganging link coupled to the handle portion.

20. The fusible switch disconnect device of claim 15, wherein the at least one in-line ganging link comprises at least one of a rod and a plate.

21. A fusible disconnect switch device comprising:

a nonconductive switch housing configured to removably accept a cylindrical overcurrent protection fuse, the nonconductive switch housing comprising a front side and a rear side opposing the front side;

a first fuse contact member and a second fuse contact member coupled to the nonconductive switch housing and configured to engage respective first and second ferrules of the overcurrent protection fuse and complete an electrical connection through the cylindrical overcurrent protection fuse, wherein the first fuse contact member is rotatably movable relative to the nonconductive switch housing, and the first fuse contact member comprises a planar conductive contact having a circular periphery and a pair of protruding keyed ribs extending from the circular periphery;

at least one movable switch contact in the nonconductive switch housing being selectively positionable in a closed position or an opened position to connect or disconnect the electrical connection through the cylindrical overcurrent protection fuse while the first fuse contact member and the second fuse contact member are engaged to the respective ferrules;

a rotary actuator configured to move the at least one movable switch contact between the opened position and the closed position; and a line-side terminal and a load-side terminal extending exterior to the rear side and being accessible from the rear side for connection to an external circuit.

22. The fusible disconnect switch device of claim 21, wherein the front side is configured to face mount the nonconductive switch housing to a panel.

23. The fusible disconnect switch device of claim 22, wherein the front side comprises an elevated surface portion, and wherein the rotary actuator comprises a handle portion projecting from the elevated surface portion.

24. The fusible disconnect switch device of claim 23, wherein a fuse cover assembly extends on the elevated surface portion.

25. The fusible disconnect switch device of claim 24, wherein the fuse cover assembly includes a cover element rotatable about a first rotational axis, and a handle element mounted to the cover element.

26. The fusible disconnect switch device of claim 25, wherein the handle element is rotatable relative to the cover element about a second rotational axis.

27. The fusible disconnect switch device of claim 26, wherein the second rotational axis is perpendicular to the first rotational axis.

28. The fusible disconnect switch device of claim 24, wherein the first fuse contact member is attached to the handle element.

29. The fusible disconnect switch device of claim 21, wherein the line-side terminal and load-side terminal include one of a wire clamp terminal, a bullet contact, or a terminal blade.

30. The fusible switch disconnect device of claim 21, wherein the nonconductive switch housing further includes a first longitudinal side and a second longitudinal side opposing the first longitudinal side with the fuse being removable accepted in between, wherein the first longitudinal side is larger than the second longitudinal side.

31. The fusible switch disconnect device of claim 21, wherein the second fuse contact member comprises a contact sleeve adapted to receive a terminal element of the cylindrical overcurrent protection fuse.

32. The fusible switch disconnect device of claim 31, wherein the terminal element of the cylindrical overcurrent protection fuse comprises a ferrule.

33. The fusible switch disconnect device of claim 21, in combination with at least one in-line ganging link.

34. The fusible switch disconnect device of claim 33, wherein the at least one in-line ganging link is coupled to the rotary actuator.

35. The fusible switch disconnect device of claim 34, wherein linear movement of the at least one in-line ganging link causes rotation of the rotary actuator.

36. The fusible switch disconnect device of claim 34, wherein the rotary actuator includes a round body and a switch extension extending radially from the round body internal to the nonconductive switch housing, the at least one in-line ganging link coupled to the switch extension.

37. The fusible switch disconnect device of claim 34, wherein the rotary actuator includes a round body and a handle portion projecting outwardly from and exterior to the nonconductive switch housing, the at least one in-line ganging link coupled to the handle portion.

38. The fusible switch disconnect device of claim 33, wherein the at least one in-line ganging link comprises at least one of a rod and a plate.

39. A low profile fusible disconnect switch device comprising:

a nonconductive switch housing configured to accept a cylindrical overcurrent protection fuse, the nonconductive switch housing comprising a front side and a rear side opposing the front side;

a fuse cover assembly on the front side and movable between opened and closed positions to permit or deny access to the cylindrical overcurrent protection fuse when in the nonconductive switch housing;

a first fuse contact member and a second fuse contact member in the nonconductive switch housing and configured to complete an electrical connection through the cylindrical overcurrent protection fuse, one of the first fuse contact member and the second fuse contact members being rotatably movable relative to the nonconductive switch housing and comprising a planar conductive contact having a circular periphery and pair of protruding keyed ribs extending from the circular periphery, and the other of the first fuse contact member being movable relative to the nonconductive switch housing along a linear axis;

at least one movable switch contact in the nonconductive switch housing to connect or disconnect the electrical connection through the first fuse contact member and a second fuse contact member and the cylindrical overcurrent protection fuse; and a rotary actuator configured to move the at least one movable switch contact between opened and closed positions to connect and disconnect the electrical connection while the overcurrent protection fuse is in the nonconductive switch housing;

wherein the front side of the nonconductive switch housing includes an elevated surface portion;

wherein the fuse cover assembly extends on the elevated surface portion;

wherein the rotary actuator comprises a handle portion projecting from the elevated surface portion; and wherein the front side is configured to be face mounted to a panel with the elevated surface portion and the fuse cover assembly extending on a first major side surface of the panel while a remainder of the nonconductive switch housing extends on a second major side surface of the panel opposite the first major side surface, whereby the overcurrent protection may be removed via the cover assembly from the front side and without having to open the panel.

40. The low profile fusible switch disconnect device of claim 39, further comprising a line-side terminal and a load-side terminal provided on and accessible from the rear side for connection to an external circuit.

41. The low profile fusible switch disconnect device of claim 39, wherein the fuse cover assembly includes a cover element rotatable about a first rotational axis, the first fuse contact member attached to the cover element and being rotatable about a second rotational axis substantially perpendicular to the first rotational axis.

42. The fusible disconnect switch device of claim 1, wherein the nonconductive switch housing has a thickness of 0.75 inches.

* * * * *